US005591275A

United States Patent [19]

Miyafuji et al.

[11] Patent Number: 5,591,275

[45] Date of Patent: Jan. 7, 1997

[54] COMPOSITION AND PROCESS FOR SURFACE TREATING METAL PRIOR TO COLD WORKING

[75] Inventors: Kazutomo Miyafuji, Izumi; Shigeo Tanaka, Yokohama; Ryoji Morita, Hiratsuka, all of Japan

[73] Assignee: Henkel Corporation, Plymouth Meeting, Pa.

[21] Appl. No.: 256,388

[22] PCT Filed: Jan. 11, 1994

[86] PCT No.: PCT/US94/00212

§ 371 Date: Jul. 13, 1995

§ 102(e) Date: Jul. 13, 1995

[87] PCT Pub. No.: WO94/16119

PCT Pub. Date: Jul. 21, 1994

[30] Foreign Application Priority Data

Jan. 13, 1993 [JP] Japan ..... 5-019410

[51] Int. Cl.[6] ..... C23C 22/86

[52] U.S. Cl. ..... 148/246; 72/42; 148/251

[58] Field of Search ..... 148/251, 246; 72/42

[56] References Cited

U.S. PATENT DOCUMENTS 4,978,399 12/1990 Kodama et al. ..... 148/150

FOREIGN PATENT DOCUMENTS 0105485 8/1981 Japan ..... 148/251
62-174386 7/1987 Japan .
1041347 9/1966 United Kingdom ..... 148/251

OTHER PUBLICATIONS

*The Friction and Lubrication of Solids,* Bowden et al., Oxford at the Clarendon Press, 1950.

EP 0091166 Oct. 1983.

*Primary Examiner*—Sam Silverberg

*Attorney, Agent, or Firm*—Wayne C. Jaeschke; Norvell E. Wisdom, Jr.; Beatrice N. Robbins

[57] ABSTRACT

A bath for treating metal surfaces for the formation thereon of composite films for the cold working of metal advantageously comprises an otherwise conventional conversion coating bath that also contains organic cationic polymer having at least 1 cationic nitrogen atom per molecule and having a molecular weight of 1,000 to 1,000,000, or a salt of such a polymer. Major improvements in the lubrication properties, particularly in the seizure resistance, can be achieved by applying out a conventional lubrication treatment on such a composite film. Specifically, practical operating limits in metal cold working, e.g., the working degree or ratio, working speed, tool life, and the like, can be increased in a single step. This is useful in terms of improving productivity, product stability, cost reduction, and the like.

10 Claims, No Drawings

COMPOSITION AND PROCESS FOR SURFACE TREATING METAL PRIOR TO COLD WORKING

TECHNICAL FIELD

The present invention relates to a composition, often denoted hereinafter as a "bath" for brevity, for treating metal surfaces and to a film formation process, wherein said bath and process are applicable for the formation of lubricating films prior to the cold working of metals and particularly of carbon steels, low alloy steels, stainless steels, steels plated with zinc or zinc alloy, titanium metal and alloys thereof, aluminiferous metals, and the like.

BACKGROUND ART

The formation of a lubricating film on metals prior to their cold working typically consists of the following two separate steps in the case of light cold working operations: the initial formation of a conversion film on the surface of the workpiece as a base layer treatment; the subsequent formation on this film of a lubricating film through the application of a lubricant. Thus, the complete lubrication treatment process comprises both a conversion step and a lubrication step.

Very high pressures (surface pressures) generally occur between the workpiece and tool during the cold working of metal. As a result, when the crystal lattice spacing (lattice constants) of the tool and workpiece are similar, the workpiece and tool ultimately weld together and bond to each other. These regions of the tool and workpiece are then torn away, leading to the occurrence of the phenomenon known as seizure. Direct contact between the workpiece and tool must therefore be avoided in order to prevent this problem. This objective is accomplished mainly through the use of a base layer film formed by conversion treatment as described above. At present, lubrication treatments consisting of the combination of such a base layer film and an appropriate lubricant are in widespread use in the metal cold working sector. The quality of the lubrication capacity exercised by the films formed by such lubrication treatment processes is related to the performance of the top layer lubrication film, but it is primarily controlled by the performance of the base layer conversion coated film.

On the other hand, recent remarkable advances in metal working technology have made possible operations even under mechanically extremely severe working conditions. However, the lubrication performance has not kept pace with these advances, and at present the performance limits of the base layer film define the limits of the lubrication performance. It is for this reason that major improvements in the performance of the base layer film (the so called lubrication film carrier) are desired.

Conversion treatment baths based on inorganic acid or low molecular weight organic acid (oxalic acid, etc.) are a technology already known as a useful point of departure for improving the lubrication carrier performance of the base layer films. Japanese Patent Application Laid Open [Kokai or Unexamined] Number Sho 62-174386 [174,386/1987] is an example of the addition of organic polymer to such conversion treatment baths in order to bring about an improvement in lubrication performance. Here, an improvement in lubrication performance is obtained by improving the film's adherence through the addition of water soluble organic polymer (excluding proteins) to an oxalate based film forming agent. The water soluble organic polymers listed for addition in the referenced patent are nonionic and have highly hydrophilic structures. In tests run by the present inventors, moderate improvements in the lubrication performance were observed, but major performance improvements were not achieved. Examining this matter from the perspective of the essential nature of lubrication, films that contain these highly hydrophilic structures do bring about a reduction in contact between tool and workpiece basis metal, but they lack the high level lubricating property of simply reducing the friction coefficient that operates between the film and tool surface.

DISCLOSURE OF THE INVENTION

Problems to be Solved by the Invention

The present invention responds to the demands generated by the performance limits that characterize the prior art in the metal cold working sector. The present invention does this by providing both a bath and a process for treating metal surfaces for the formation thereon of composite films for the cold working of metal, wherein said bath and process provide major improvements in tool life, working degree or ratio, working speed, and the like.

SUMMARY OF THE INVENTION

As the result of extensive research in response to the demands described above, the inventors discovered that a high level lubrication performance is achieved by the formation on the metal surface of a composite film using a conversion treatment bath that contains a special type of organic polymer or salt thereof.

Specifically, the present invention relates to a bath for treating metal surfaces for the formation thereon of composite films for the cold working of metal, wherein said bath characteristically comprises a conversion treatment bath that contains organic cationic polymer having at least 1 cationic nitrogen atom per polymer molecule and having a molecular weight of 1,000 to 1,000,000 or that contains a salt of an aforesaid organic cationic polymer.

The present invention also relates to a process for the formation of composite films for the cold working of metal, wherein said process is characterized by the formation of a composite film by treating the surface of a metal with a conversion treatment bath that contains organic cationic polymer having at least 1 cationic nitrogen atom per polymer molecule and having a molecular weight of 1,000 to 1,000,000 or that contains a salt of an aforesaid organic cationic polymer.

The composite film that is the subject of the present invention consists of a film in which resin and inorganic crystals have formed a composite. In this composite film, the resin (=organic cationic polymer or salt thereof) has penetrated into and resides in the grain boundaries between the inorganic crystals that are formed by the conversion treatment bath.

The metal surface treatment bath used by the present invention comprises a base conversion treatment bath in which organic cationic polymer (or salt thereof) is dissolved or stably dispersed. Said base conversion treatment bath is selected from the known phosphate treatment baths, oxalate treatment baths, and fluoride containing treatment baths, and should be selected as appropriate to the type of metal undergoing treatment. For example, when the treatment substrate is carbon steel, low alloy steel, steel plated with zinc or zinc alloy, or aluminum, the bath can be selected as desired from the usual phosphate treatment baths. The phosphate treatment baths are exemplified by zinc phosphate baths, zinc/calcium phosphate baths, and manganese phosphate baths. Oxalate treatment baths are used for stainless steels, and fluoride containing treatment baths are used for titanium metals and aluminum metals. These fluoride containing treatment baths are made up from fluoride and an inorganic acid such as sulfuric acid or phosphoric acid, etc.

The organic polymer present in the metal surface treatment bath of the present invention should contain at least 1 cationic nitrogen atom per polymer molecule and should have a molecular weight of 1,000 to 1,000,000. Preferably, with increasing preference in the order given, the molecular weight of the polymer does not exceed, 500,000, 250,000, 100,000, 50,000, 30,000, or 22,000. Although the chemical nature of the polymer, except for the requirement to contain cationic nitrogen, is not restricted, organic polymers defined as follows are particularly preferred: organic polymers that contain at least 1 type of resin skeleton selected from epoxy resins, urethane resins, polybutadiene resins, acrylic resins, and maleic anhydride resins.

Suitable salts of the organic cationic polymer encompass inorganic acid salts (e.g., phosphoric acid salts, nitric acid salts, sulfuric acid salts, etc.) and organic acid salts (e.g., propionic acid salts, gluconic acid salts, etc.) of the above described organic cationic polymers. These organic cationic polymers and salts thereof can be used individually or in combinations of two or more. The improvement in lubrication performance is poor when the organic polymer has a molecular weight less than 1,000. When its molecular weight exceeds 1,000,000, it becomes highly problematic to obtain its solution or stable dispersion in the base conversion treatment bath. Still lower molecular weights as already noted above provide even more effective results.

Other types of resins, activators, etc., can also be added as necessary.

The metal surface treatment process in accordance with the present invention can be implemented by a spray or immersion conversion treatment or by electrolytic treatment, but the mechanical aspects of the treatment process using the treatment agent of the present invention are not specifically restricted.

The above described conversion film is used in combination with an overlayer or top layer of lubricant; however, the type of this lubricant is not specifically restricted. Operable in this regard are certainly the soap lubricants, oils, and mineral oil lubricants that are currently in the most widespread use for metal cold working. Synthetic organic lubricants, etc., are also useable in this regard.

For example, micropowders of calcium soaps are typically used as lubricants in the wire drawing of steel wire. The organic polymer deposited in the grain boundaries of the conversion film crystals functions to promote a robust and continuing adherence by this lubricant to the surface of the steel wire. Due to this excellent carrier function, the lubricant under consideration is delivered in larger quantities to the die during wire drawing. This improvement in delivery efficiency results in a highly favorable lubrication performance. This in turn makes possible such effects as an improvement in die life, an increase in the wire drawing velocity, and an increase in the cross section reduction.

In pipe drawing and forging, an immersion treatment is generally carried out at ambient or elevated temperature using a water soluble sodium soap lubricant, oil (straight or emulsified), or mineral oil lubricant. The deposited organic polymer does not dissolve out, exfoliate, or delaminate even in these treatments and remains strongly adherent. This results in the development of excellent lubrication effects and avoids any restrictions on the lubricant's use conditions.

Finally, in the press working sector, an excellent lubrication performance is again developed due to the same effects discussed above for wire drawing, pipe drawing, and forging. The lubricants used in this sector normally consist of oils that contain extreme pressure additives, as represented by the usual press oils. This type of oil resists removal in degreasing processes, and its removal after working is therefore quite problematic. When a composite lower layer conversion film has been formed using the metal surface treatment bath in accordance with the present invention, the use of a high viscosity oil (e.g., press oil, etc.) as the upper layer lubricant becomes unnecessary, and a thoroughly satisfactory lubrication performance can be obtained even using a low viscosity anticorrosion oil. This produces the advantage of easy removal of the oil after the working operation. Moreover, since a conversion film has already been laid down on the workpiece, coating or painting can be carried out immediately after degreasing. In addition, the organic polymer containing composite film also gives excellent post painting properties. The present invention is strongly differentiated from the prior art films that contain water soluble organic compounds because the latter make only a small contribution to the lubrication performance and give extremely poor post painting properties.

The organic polymer is generally added to the conversion treatment bath at 0. 1 to 50 grams per liter (hereinafter often abbreviated "g/L") as solids. With increasing preference in the order given, the amount of cationic polymer dissolved and/or dispersed in the conversion treatment bath will be from 0.5 to 40, 1.0 to 27, 1.7 to 20, 2.5 to 11, 3.0 to 8.7, 3.5 to 7.5, or 4.0 to 6.0, g/L as solids It has been found to be very difficult to obtain similar film deposition and formation of a composite film structure when an anionic or nonionic organic polymer is used in place of the organic cationic polymer as specified above.

When a metal surface is subjected to a conversion treatment, the basis metal is ordinarily eluted and the pH of the conversion treatment bath increases at its interface with the metal. The mechanism underlying conversion film formation consists of the deposition of insoluble inorganic salts due to the increase in pH and the formation—and deposition—of insoluble salts formed between the eluted metal ion and components of the conversion treatment bath.

The organic cationic polymer present in the conversion treatment bath in accordance with the present invention is dissolved or dispersed in the water in cationic form. It appears that the pH increase, in the close vicinity of the metal surface, associated with conversion coating as noted above, promotes deposition of the organic cationic polymer by reducing its solubility or dispersibility. In consequence thereof, when a metal is treated with the surface treatment agent in accordance with the present invention, the organic polymer apparently precipitates simultaneously with the inorganic salts and a composite film is thereby formed.

The organic polymer participates in the formation of the composite film by precipitating in the form of solid resin in the grain boundaries of the conversion film crystals. This appears to induce an improvement in the adherence of the conversion film to the basis metal. In addition, at the extreme pressure lubrication conditions encountered during the cold working of metals, a film is formed that apparently prevents metal/metal contact between the workpiece and tool and that thus functions like an extreme pressure film. This results in a major improvement in lubrication performance and particularly in resistance to seizure.

The present invention is characterized by the use of a conversion treatment bath that contains organic cationic polymer or salt thereof. Thus, for example, the effects are minor when the surface of the metal workpiece is first treated with the base conversion treatment bath and then treated with a solution that contains organic cationic polymer or salt thereof. In this case, a resin film is merely formed on top of the conversion film and formation of a composite film does not occur, with the result that exfoliation of at least the polymer film during cold working becomes quite easy. The working examples provided hereinafter will confirm that the composite film in accordance with the present invention achieves a high level of lubrication performance.

EXAMPLES

Working examples of the present invention are provided below along with comparison examples in order to demonstrate the effects of the invention in specific detail. However, the invention is not limited to the examples, which are provided simply as individual examples of surface treatment in support of cold working in general.

1. Test materials

The form, material, and dimensions of the tested metals are reported below.

Carbon steel: hard steel wire, SWRH62A, 2.05 mm in diameter

Galvanized steel: steel sheet hot-dip galvannealed on both sides (add-on for each side: 60 g/m$^2$), 0.8 mm thick Stainless steel: pipe, SUS304, 46 mm in diameter×4 mm thick×5000 mm long Aluminum: forging grade, 51S (Alcoa designation)

2. Surface treatment agents tested

Table 1 reports the type of pretreatment and pretreatment conditions for the various test materials. Table 2 reports the type and conditions for the base conversion treatment. Table 3 reports the type and quantity of addition for the organic polymers that were added to the conversion treatment baths in both the invention examples and comparison examples. Table 4 reports the type of lubricant top layer used after the conversion treatment and the conditions for its application.

TABLE 1

Type of Pretreatment and Pretreatment Conditions for the Test Materials

| Metal Treated | Pretreatment Conditions |
|---|---|
| Carbon steel | 15% HCl, 15 minutes immersion |
| Galvanized steel | 0.3% PL-Z, 5 seconds immersion |
| Stainless steel | 10% $HNO_3$ + 4% HF, 20 minutes immersion |
| Aluminum | 30% $HNO_3$, 10 minutes immersion |

Notes for Table 1

All the pretreatments were at ambient temperature. Water formed the balance of the treatment compositions not stated. "PL-Z" means PREPALENE ™ Z, a commercial product of Nihon Parkerizing Co., Ltd.

TABLE 2

Type and Conditions for the Base Conversion Treatment

| No. | Type | Treatment Bath Compositions | | Treatment Conditions |
|---|---|---|---|---|
| a | Zn phosphate A | PB-421WDM[1]: + AC-131[2]: | 65 g/L 0.3 g/L | 80° C., 8 minutes, immersion |
| b | Zn phosphate B | PB-3300M[3]: | 45 g/L | 60° C., 8 seconds, immersion |
| c | oxalate salt | FBA-1[4]: + FBA-2[5]: + AC-16[6]: | 40 g/L 20 g/L 1 g/L | 90° C., 15 minutes, immersion |
| d | fluoride | ABA[7]: | 30 g/L | 93° C., 5 minutes, immersion |

Footnotes for Table 2

[1]PALBOND ™ 421WDM, a zinc phosphate conversion film forming agent (for carbon steel)

[2]ACCELERATOR ™ 131, an accelerant for conversion film forming reactions

[3]PALBOND ™ 3300M, a zinc phosphate conversion film forming agent (for galvanized steel)

[4]FERRBOND ™ A-1, a base for ferrous oxalate conversion film formation (for stainless steel)

[5]FERRBOND ™ A-2, a promoter for oxalate conversion film formation

[6]ACCELERATOR ™ 16, an accelerant for conversion film forming reactions

[7]ALBOND ™ A, a zinc fluoride conversion film forming agent (for aluminum)

Additional Notes for Table 2

All the product names with identifiying footnotes are products of Nihon Parkerizing Company, Limited.

The balance not shown for the Treatment Bath Compositions was water.

TABLE 3

Types of Organic Polymers Added to the Conversion Baths

| No. | Chemical Nature | Molecular Weight |
|---|---|---|
| A | adduct of $NH(CH_3)_2$ with bisphenol A-type epoxy resin | 8,800 |
| B | copolymer of methyl methacrylate and dimethylaminoethyl methacrylate | 20,000 |
| C | adduct of $H_2NCH_2N(CH_3)_2$ with maleic anhydride resin | 2,000 |
| D | adduct of $H_2NCH_2N(CH_3)_2$ with maleic anhydride resin | 800 |
| E | polyvinyl alcohol | 3,000 |
| F | polyacrylic acid | 10,000 |

Note for Table 3

Nos. A, B, and C are for examples according to the invention, while Nos. D, E, and F are for comparison only.

TABLE 4

Type of Lubricant Top Layer Used after Conversion Treatment and Conditions for Its Application

| No. | Type | Treatment Composition | Treatment Conditions |
|---|---|---|---|
| a | dry soap | COSHIN ™ No. 10[1] (calcium stearate soap powder) | pre-die application |
| b | soap | PALUBE ™ 4601[2] (sodium stearate soap base): 40 g/L | 80° C., 3 minutes, immersion |
| c | oil A | NOXRUST ™-550H[3] | roll squeegee |
| d | oil B | KOSAKUYU ™ 660[4] | roll squeegee |
| e | resin | organic polymer[5]: 50 g/L | roll squeegee |

Footnotes for Table 4

[1]dry lubricant for wire drawing, product of Kyoeisha Yushi Kogyo Kabushiki Kaisha

[2]wet soap lubricant, product of Nihon Parkerizing Company, Limited

[3]anticorrosion oil, product of Parker Kosan Kabushiki Kaisha

[4]press oil, product of Nippon Kosakuyu Kabushiki Kaisha

[5]resin sealant = No. B in Table 3

3. Treatment method

A lubrication treatment was executed on the test materials by the process sequence given below. The water washes carried out after pickling in the pretreatment step and after the conversion treatment consisted of immersion for 1 minute in running tap water. Drying was carried out for 5 minutes in a hot air circulation oven at 100° C. Test materials were used that were free of adhering oil.

Process Sequence: pretreatment→water wash (except for galvanized steel)→conversion treatment→water rinse→treatment with lubricant→drying.

4. Performance evaluation testing

The performance afforded by the lubrication treatments described above was evaluated by the following test methods.

4-1. Evaluation of the seizure resistance

Using an EFM-4 Model of Bowden-Leben friction coefficient tester produced by Toyo Baldwin Kabushiki Kaisha, under conditions reported in Table 5, the following two parameters were evaluated: (1) the initial coefficient of friction when sliding was initiated, and (2) the number of slides until seizure (defined as a coefficient of friction=0.3).

TABLE 5

| | |
|---|---|
| Pressure element: | SUJ-2, 5 mm diameter sphere |
| Load: | 5 kg |
| Temperature: | 30° C. |
| Slide length: | 10 mm |
| Sliding velocity: | 10 mm/sec |

4-2. Wire drawing evaluation

The following two parameters were evaluated using a dry continuous wire drawing machine produced by Miyazaki Tekko Kabushiki Kaisha and the wire drawing test conditions reported in Table 6: (1) surface planarity ratio of the finished wire, and (2) the total quantity of drawn wire that met a finished wire dimensional tolerance of ±1/100. The surface planarity is a parameter indicative of the lubrication conditions during the wire drawing process. In general, smaller values for the planarity ratio are indicative of a better lubrication.

TABLE 6

| Wire sizes: | |
|---|---|
| parent wire diameter: | 2.05 mm |
| finished wire diameter: | 0.67 mm |
| Cross section reduction: | 89.3% |
| Number of dies: | 10 |
| Wire speed: | 680 m/minute |

4-3. Evaluation of tube drawing

The drawing force, core force, and the presence/absence of seizure (indicative of drawing conditions) were evaluated using a chain type drawing bench and the tube drawing test conditions reported in Table 7. A lower drawing force and lower core force are indicative of better lubrication.

TABLE 7

| | | |
|---|---|---|
| Drawing sizes: | First pass: | 46 mm diameter × 4 mm thick to 42 mm diameter × 3 mm thick (core draw) |
| | Second pass: | 42 mm diameter × 3 mm thick to 37 mm diameter × 3 mm thick (coreless draw) |
| Cross section reduction: | First pass: | 30% |
| | Second pass: | 13% |
| | Total: | 39% |
| Drawing speed: | | 15 meters/minute |

4-4. Evaluation of the pressability

The following two parameters were evaluated using a high speed deep draw tester made by Tokyo Shikenki Seisakujo Kabushiki Kaisha [Tokyo Test Equipment Mfg. Company, Limited] and the press testing conditions given in Table 8: (1) the punch load for a draw ratio=2.0 and a blankholding pressure of 3 tons, and (2) the critical blankholding pressure at a draw ratio of 2.3. Lower punch loads and higher critical blankholding pressures are indicative of a better lubrication.

TABLE 8

| | |
|---|---|
| Blank size: | 100 mm diameter (draw ratio = 2.0)<br>115 mm diameter (draw ratio = 2.3) |
| Punch size: | 50 mm diameter |
| Punch shoulder: | 5 mm radius |
| Die size: | 52 mm diameter |
| Die shoulder: | 5 mm radius |
| Punch velocity: | 30 mm/minute |
| Temperature: | 30° C. |

5. Results of the performance evaluations

Table 9 reports the results of the performance evaluations for the working and comparison examples. The results in this table demonstrate that the invention examples (numbers 1 to 12) gave a lubrication performance for the various materials that was superior to the lubrication performance afforded by the comparison examples (numbers 13 to 25).

TABLE 9

Results of the Performance Evaluations

| | | | | | | Seizure Resistance | | Wire Drawing Performance | |
|---|---|---|---|---|---|---|---|---|---|
| | | | Polymer | | | Initial | Number | | |
| No. | Test Material | Treatment Type | Polymer Type | Amount, (g/L) | Lubrication Type | Coefficient of Friction | of Slides until Seizure | Total Amount of Wire Drawn, Kg | Surface Planarity |
| 1 | carbon steel | a | A | 5 | a | 0.11 | 977 | 3200 | 65 |
| 2 | carbon steel | a | B | 5 | a | 0.10 | 870 | 3100 | 68 |
| 3 | carbon steel | a | C | 5 | a | 0.10 | 825 | 2700 | 72 |
| 4 | galvanized steel | b | A | 5 | c | 0.10 | 270 | — | — |
| 5 | galvanized steel | b | B | 5 | c | 0.12 | 280 | — | — |
| 6 | galvanized steel | b | C | 5 | c | 0.12 | 215 | — | — |

TABLE 9-continued

Results of the Performance Evaluations

| | | | | | | | | | |
|---|---|---|---|---|---|---|---|---|---|
| 7 | stainless steel | c | A | 5 | b | 0.11 | 260 | — | — |
| 8 | stainless steel | c | B | 5 | b | 0.12 | 320 | — | — |
| 9 | stainless steel | c | C | 5 | b | 0.12 | 365 | — | — |
| 10 | aluminum | d | A | 5 | b | 0.11 | 160 | — | — |
| 11 | aluminum | d | B | 5 | b | 0.10 | 140 | — | — |
| 12 | aluminum | d | C | 5 | b | 0.12 | 185 | — | — |
| 13 | carbon steel | a | none | — | a | 0.13 | 265 | 1700 | 84 |
| 14 | carbon steel | a | D | 5 | a | 0.12 | 460 | 1900 | 78 |
| 15 | carbon steel | a | E | 5 | a | 0.11 | 350 | 2100 | 80 |
| 16 | carbon steel | a | F | 5 | a | 0.12 | 385 | 2000 | 81 |
| 17 | carbon steel | a | none | — | e → a | 0.12 | 585 | 2300 | 76 |
| 18 | galvanized steel | b | none | — | c | 0.15 | 93 | — | — |
| 19 | galvanized steel | b | D | 5 | c | 0.13 | 120 | — | — |
| 20 | galvanized steel | b | E | 5 | d | 0.14 | 110 | — | — |
| 21 | galvanized steel | b | none | — | e → c | 0.14 | 165 | — | — |
| 22 | stainless steel | c | none | — | b | 0.12 | 105 | — | — |
| 23 | stainless steel | c | F | 5 | b | 0.15 | 128 | — | — |
| 24 | aluminum | d | none | — | b | 0.12 | 63 | — | — |
| 25 | aluminum | d | D | 5 | b | 0.11 | 75 | — | — |

| | Tube Drawing Performance | | | | | | |
|---|---|---|---|---|---|---|---|
| | Drawing Force, (Kg/mm²) | | Core force, (Kg/mm²) | | Evaluation of | | |
| No. | 1st Pass | 2nd Pass | 1st Pass | 2nd Pass | Seizure | Punch Load, Tons | Critical Blankholding Pressure, Tons |
| 1 | — | — | — | — | — | — | — |
| 2 | — | — | — | — | — | — | — |
| 3 | — | — | — | — | — | — | — |
| 4 | — | — | — | — | — | 4.63 | 2.0 |
| 5 | — | — | — | — | — | 4.54 | 1.75 |
| 6 | — | — | — | — | — | 4.58 | 2.0 |
| 7 | 38.2 | 19.7 | 2.26 | coreless | ++ | — | — |
| 8 | 37.8 | 18.8 | 2.05 | coreless | ++ | — | — |
| 9 | 39.3 | 20.7 | 1.85 | coreless | ++ | — | — |
| 10 | — | — | — | — | — | — | — |
| 11 | — | — | — | — | — | — | — |
| 12 | — | — | — | — | — | — | — |
| 13 | — | — | — | — | — | — | — |
| 14 | — | — | — | — | — | — | — |
| 15 | — | — | — | — | — | — | — |
| 16 | — | — | — | — | — | — | — |
| 17 | — | — | — | — | — | — | — |
| 18 | — | — | — | — | — | 5.68 | <0.25 |
| 19 | — | — | — | — | — | 5.34 | <0.25 |
| 20 | — | — | — | — | — | 5.15 | <0.25 |
| 21 | — | — | — | — | — | 4.86 | 0.75 |
| 22 | 46.4 | 25.8 | 4.86 | coreless | x | — | — |
| 23 | 43.1 | 24.2 | 4.46 | coreless | + | — | — |
| 24 | — | — | — | — | — | — | — |
| 25 | — | — | — | — | — | — | — |

Note for Table 9
With regard to the type of lubrication treatment for Comparison Examples 17 and 21 "e → a" and "e → c" indicate that resin sealing "e" was carried out after conversion treatment and that this was additionally followed by lubrication treatment "a" or "c".

BENEFITS OF THE INVENTION

A major improvement in lubrication properties—and particularly in the seizure resistance—can be obtained by carrying out a lubrication treatment after the formation of a composite film on a metal surface using the metal surface treatment agent in accordance with the present invention. Specifically, the invention makes possible in a single step an increase in such practical operating limits in metal cold working as the working degree or ratio, working speed, tool life, and the like. The invention is therefore useful in terms of improving productivity, product stability, cost reduction, and the like.

The invention claimed is:

1. A process for forming a lubricating film on a metal surface, said process comprising steps of:

(I) forming on the metal surface a conversion coating by contacting the metal surface with a liquid aqueous conversion treatment composition that comprises (i) a base conversion treatment composition selected from the group consisting of phosphate treatment compositions, oxalate treatment compositions, and fluoride treatment compositions and (ii) from 0.1 to 50 g/L, measured as solids, of a total of organic cationic polymer having at least one cationic nitrogen atom per molecule and having a molecular weight of 1,000 to 1,000,000, salt of such an organic cationic polymer, or both polymer and salt thereof, and (II) applying over the conversion coating formed in step (I) a lubricant film for cold working operations.

2. A process according to claim 1, wherein said liquid aqueous conversion treatment composition comprises from 1.0 to 27 g/L, measured as solids, of a total of said organic cationic polymer, said cationic polymer having a molecular weight from 1,000 to 250,000, salt thereof, or both polymer and salt thereof.

3. A process according to claim 2, wherein said liquid aqueous conversion treatment composition comprises from 2.5 to 11 g/L, measured as solids, of a total of said organic cationic polymer, said cationic polymer having a molecular weight from 1,000 to 100,000, salt thereof, or both polymer and salt thereof.

4. A process according to claim 3, wherein said liquid aqueous conversion treatment composition comprises from 3.5 to 7.5 g/L, measured as solids, of a total of said organic cationic polymer, said cationic polymer having a molecular weight from 1,000 to 50,000, salt thereof, or both polymer and salt thereof.

5. A process according to claim 4, wherein said lubricant film is selected from the group consisting of soaps, mineral oils, and synthetic organic substances.

6. A process according to claim 3, wherein said lubricant film is selected from the group consisting of soaps, mineral oils, and synthetic organic substances.

7. A process according to claim 1, wherein said lubricant film is selected from the group consisting of soaps, mineral oils, and synthetic organic substances.

8. A metal treating process according to claim 1, said process comprising an additional step of:

(III) cold working the metal surface as prepared at the end of step (II).

9. A metal treating process according to claim 5, said process comprising an additional step of:

(III) cold working the metal surface as prepared at the end of step (II).

10. A metal treating process according to claim 5, said process comprising an additional step of:

(III) cold working the metal surface as prepared at the end of step (II).

* * * * *